US006116801A

United States Patent [19]

Patel et al.

[11] Patent Number: 6,116,801

[45] Date of Patent: Sep. 12, 2000

[54] PRODUCT DISPENSER AND HOLDER

[75] Inventors: Manhar K. Patel, Saddle Brook; Albert J. Stiso, Brick, both of N.J.; Robert Nathan Le Bras-Brown, New York, N.Y.; James J. Thalheimer, Toms River, N.J.

[73] Assignee: Revlon Consumer Products Corporation, New York, N.Y.

[21] Appl. No.: 09/118,358

[22] Filed: Jul. 17, 1998

[51] Int. Cl.[7] ..... A45D 40/06

[52] U.S. Cl. ..... 401/78; 401/87

[58] Field of Search ..... 401/78, 87, 86, 401/88, 68, 75

[56] References Cited

U.S. PATENT DOCUMENTS

| | | |
|---|---|---|
| 1,835,580 | 12/1931 | Wild . |
| 2,302,473 | 11/1942 | Reichenbach . |
| 2,318,152 | 5/1943 | Gelardin . |
| 2,469,631 | 5/1949 | Broder . |
| 2,797,803 | 7/1957 | Hopgood . |
| 2,798,599 | 7/1957 | Croce . |
| 2,815,123 | 12/1957 | Safianoff . |
| 2,838,169 | 6/1958 | Grau . |
| 3,083,822 | 4/1963 | Clark . |
| 3,298,509 | 1/1967 | Hultgren . |
| 4,820,070 | 4/1989 | Spatz . |
| 5,197,814 | 3/1993 | Lombardi et al. . |
| 5,560,727 | 10/1996 | Vaupel . |
| 5,599,124 | 2/1997 | Ackermann et al. . |
| 5,609,430 | 3/1997 | Mazzola et al. . |
| 5,865,550 | 2/1999 | Bouix ..... 401/78 |

FOREIGN PATENT DOCUMENTS

| | | |
|---|---|---|
| 599960 | 6/1960 | Canada . |
| 0182655 A2 | 5/1986 | European Pat. Off. . |
| 0 568 555 B1 | 11/1993 | European Pat. Off. . |
| 2698528 | 6/1994 | France . |
| 3442094A | 5/1986 | Germany . |
| 406090819 | 4/1994 | Japan . |
| WO 96/32031 | 10/1996 | WIPO . |
| WO 97/09903 | 3/1997 | WIPO . |

*Primary Examiner*—Charles R. Eloshway
*Attorney, Agent, or Firm*—Lerner, David, Littenberg, Krumholtz & Mentlik, LLP

[57] ABSTRACT

A dispenser includes a holder/carrier for products of stick-like form to enable application of a wide variety of materials. A plurality of resilient/flexible barbs having spring-like properties extend into the holder/carrier for embedding into the received material. The barbs preclude dislodgment of the stick-like product which may occur due to vibration caused during shipment or subsequent use of the dispenser.

59 Claims, 5 Drawing Sheets

PRODUCT DISPENSER AND HOLDER

FIELD OF THE INVENTION

The present invention relates in general to dispensers for products having a generally stick-like form, by way of example, cosmetic products, personal care and hygiene products, household products and the like.

BACKGROUND OF THE INVENTION

Products having a stick-like form for dispensing are generally in the nature of semi-solid or highly viscous materials, such as known cosmetic products which include lipstick, eye shadow, eye liner, mascara and the like. Other products which are dispensable in stick-like form are known as personal care and hygiene products, for example, deodorants, lip balms, sunscreens, insect repellents and the like. Generally, there are known other products such as household products which can be dispensed in stick-like form, for example, adhesives, polishes and the like. There is therefore known a number of products in stick-like form which are dispensable for various applications.

One form of a known dispenser for cosmetics is referred to as a lipstick case. The lipstick case generally includes a housing which is covered by a removable cap when the contained lipstick in stick-like form is in a retracted position. Upon removing the cap, the lipstick is advanced through the housing by means of a mechanism so as to expose the lipstick for application. The lipstick is typically mounted in a holder or carrier which is engaged by the mechanism to enable the lipstick to be moved within the housing between the retracted storage position and the extended user position. In order for the dispenser to function properly, it is a requirement that the lipstick be securely fastened within its holder or carrier.

To this end, there is known various designs for securing a lipstick to its holder or carrier. For example, Vaupel, U.S. Pat. No. 5,560,727 discloses a lipstick carrier having a spring element provided with an outwardly facing cam which engage a recess at the end of an outer lipstick tube to prevent the lipstick carrier from slipping out of the lipstick tube. At other times when the lipstick is retracted, rear engagement lugs on the spring element embed into the lipstick upon engagement of the cam with the inner surface of the lipstick tube to prevent the lipstick from slipping out of the lipstick carrier. However, the securing action is eliminated when the lipstick is fully extending, which can cause the lipstick to accidentally dislodge from the lipstick carrier during use.

Hopgood, U.S. Pat. No. 2,797,803 and Wild, U.S. Pat. No. 1,835,580 disclose a rigid metal carrier of open cylindrical cup shape. A pair of inwardly directed lugs formed from a portion of the metallic carrier are operative for retaining the inserted stick cosmetic, for example, stick colognes, stick deodorants and the like.

Reichenbach, U.S. Pat. No. 2,302,473 discloses a lipstick carrier having a metallic cup-shaped carrier formed with an annular inwardly projecting rib to aid in retaining the lipstick within the carrier.

Mazzola, et al., U.S. Pat. No. 5,609,430; Ackermann, et al., U.S. Pat. No. 5,599,124; Lombardi, et al., U.S. Pat. No. 5,197,814; Clark, U.S. Pat. No. 3,083,822; Grau, U.S. Pat. No. 3,838,169; Hultgren, U.S. Pat. No. 3,298,509; Spatz, U.S. Pat. No. 4,820,070 and German Patent No. DE 3442094 disclose a lipstick carrier provided with a plurality of inwardly directed longitudinally extending ribs for engaging the lipstick and securing same within the carrier.

Croce, U.S. Pat. No. 2,798,599 discloses a lipstick carrier having a pair of spaced apart helical ribs projecting inwardly for engaging the lipstick. When a lipstick is inserted into the carrier, the lipstick is cammed by the internal ribs so as to turn itself during the insertion operation thereby anchoring the lipstick in the carrier.

Gelardin, U.S. Pat. No. 2,318,152 discloses a lipstick carrier provided with a pair of inwardly directed tongues formed as dihedral angles with a sharp outer edge. The outer edges of the tongues are notched for anchoring a lipstick within the carrier against displacement therefrom.

Broder, U.S. Pat. No. 2,469,631 discloses a lipstick carrier having a base plate from which there extends a plurality of triangular-shaped prongs into which the lipstick is pressed.

Safianoff, U.S. Pat. No. 2,815,123 discloses a lipstick carrier which includes an internal ring supported by a plurality of radially extending ribs into which the bottom of a lipstick is embedded.

Notwithstanding the foregoing, there has been recognized a continuous problem of the lipstick or other product to be dispensed in stick-like form being dislodged from its holder or carrier. This can occur when the dispenser is subject to vibration, shock or repeated movement, such as during shipment. Under these conditions, it is possible for the formed tip of the lipstick to compress into the inner surface of the cap so as to be deformed. This results in a product which is not acceptable to the consumer, thereby often prompting return of the dispenser by either the distributor or consumer.

Accordingly, there is still the room for improvements in dispensers for various products which are provided in stick-like form in the nature of a semi-solid or highly viscous material for a multitude of applications.

SUMMARY OF THE INVENTION

It is an object of the present invention to provide a product dispenser for semi-solid or highly viscous materials, such as cosmetic products, personal care and hygiene products, household products and the like which are provided generally in stick-like form.

It is also an object of the present invention to provide a product dispenser having a holder or carrier for securely retaining a product of stick-like form within the dispenser subsequent to manufacture, for example, during shipment, storage and subsequent use by the consumer.

In accordance with the present invention, which may be used with various types of dispensers for products in stick-like form, it has been discovered that one of the problems of the known dispensers has been the retention of the product within the holder or carrier which forms part of the dispenser. Thus, the present invention finds particular use in those dispensers generally referred to in the art as screwtype dispensers, or other such dispensers which require the use of a holder or carrier for the product.

To ensure that the product to be dispensed remains secure within the holder or carrier at all times, at least one, and preferably a plurality of barbs are formed extending from the holder or carrier. The barbs are formed of resilient polymer material having spring-like properties while being resiliently flexible. The barbs are displaceable into a generally non-interfering position upon insertion of the product into the holder or carrier. Displacement of the barbs is facilitated by cooling the product below room temperature to increase its hardness. Subsequently, the barbs due to their spring-like properties, reorient themselves away from the interior surface of the holder or carrier so as to embed themselves into the product. In the event of vibration which would tend to cause the product to move axially within the holder or carrier, the barbs will penetrate further into the product further securing the product from movement. The penetration of the barbs into the product is facilitated by the spring-like properties of the barbs and the product being semi-solid or viscous in nature, particularly when returned to room temperature after insertion into the holder or carrier during the manufacturing process.

In accordance with one embodiment of the present invention there is described a holder for a product having a stick-like form, the holder comprising a body having an interior portion defining an opening adapted for receiving a portion of the product, at least one barb of polymer material extending away from the interior surface into the opening, the barb being displaceable proximate the interior surface upon the holder initially receiving the product therein, and thereafter, being extendible away from the interior surface into a portion of the product for preventing the product from being dislodged from the holder.

In accordance with another embodiment of the present invention there is described a holder for a product having a stick-like form, the holder comprising a body having an interior portion defining an opening adapted for receiving a portion of the product, at least one barb of polymer material extending away from the interior surface into the opening, the barb including a resilient portion having a cross-sectional thickness less than an adjacent portion of the barb.

In accordance with another embodiment of the present invention there is described a dispenser for a product having a stick-like form, the dispenser comprising a housing, a product within the housing moveable between a storage position and a user position, a holder for receiving the product moveable within the housing between the storage position wherein the product is inaccessible for use and the user position wherein the product is accessible for use, the holder including a tubular body having an interior surface defining an opening receiving a portion of the product therein, and at least one barb of polymer material extending away from the interior surface, the barb being displaceable proximate the interior surface upon the holder initially receiving the product therein, and thereafter, being extendible away from the interior surface into a portion of the product for preventing the product from being dislodged from the holder when the holder is in the storage position and the user position.

In accordance with another embodiment of the present invention there is described a dispenser for a product having a stick-like form, the dispenser comprising a housing, a product within the housing moveable between a storage position and a user position, a holder for receiving the product moveable within the housing between the storage position wherein the product is inaccessible for use and the user position wherein the product is accessible for use, the holder including a tubular body having an interior surface defining an opening receiving a portion of the product therein, and at least one barb of polymer material extending away from the interior surface, the barb including a resilient portion having a cross-sectional thickness less than an adjacent portion of the barb, the barb preventing the product from being dislodged from the holder when the holder is in the storage position and the user position.

BRIEF DESCRIPTION OF THE DRAWINGS

The above description, as well as further objects, features and advantages of the present invention will be more fully understood with reference to the following detailed description of a product dispenser and holder, when taken in conjunction with the accompanying drawings, wherein.

DETAILED DESCRIPTION OF THE PREFERRED EMBODIMENTS

Figure 1:
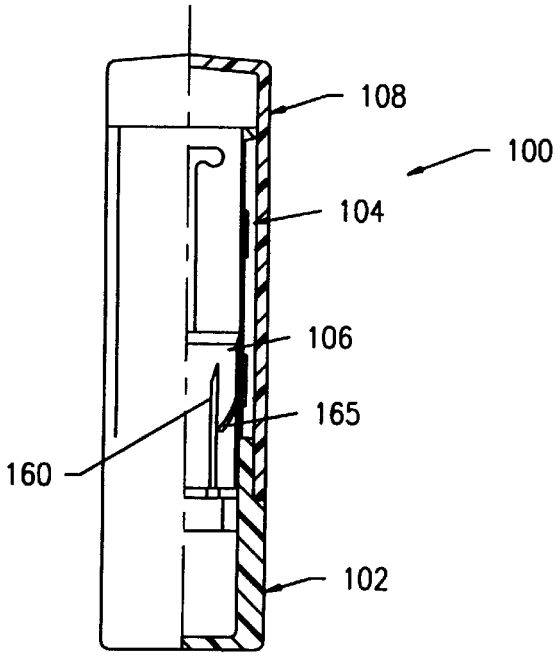
FIG. 1 is a cross-sectional view of an assembled dispenser constructed in accordance with one embodiment of the present invention.

Referring to the drawings, wherein like reference numerals represent like elements, there is shown in FIG. 1 an assembled dispenser constructed in accordance with one embodiment of the present invention and generally designated by reference numeral 100. The dispenser 100 is constructed from an inner base 102, a surrounding outer shell 104, a holder/carrier 106 and an outer cap 108. The components as thus far described can be formed from suitable plastic materials by injection molding or the like.

Figure 2:
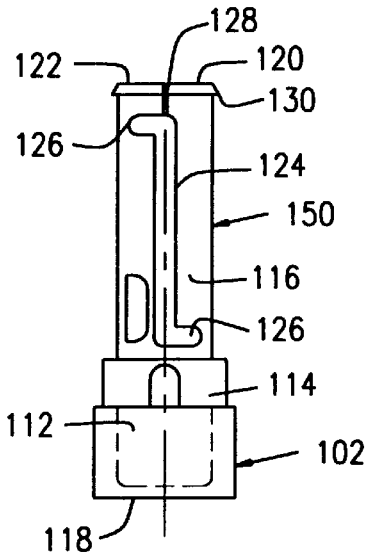
FIG. 2 is a cross-sectional view of the dispenser base.

The base 102, as shown in FIG. 2, is formed from a hollow tubular member 110 which includes three segments 112, 114, 116 of varying diameter having their longitudinal axes in alignment with one another. Segment 112 is formed with a closed bottom 118 and segment 116 is formed with an open end 120 surrounded by a protruding rib 122. Due to the varying diameters between the segments 112, 114, 116, the tubular member 110 has a telescopic appearance.

Segment 116 is provided with a pair of elongated openings 124 extending in the longitudinal direction of the segment terminating at either end by a lateral opening 126. The openings 124 are generally spaced apart around segment 116 by 180°, only one such opening being shown. The upper end of opening 124 adjacent lateral opening 126 is provided with a slot 128 which extends through rib 122 to enable the upper end of the tubular member 110 to be spread open to create a greater effective diameter as to be described hereinafter. The surrounding rib 122, due to its tapered shape, is provided with an underlying lip 130 circumscribing the tubular member 110.

Figure 3:
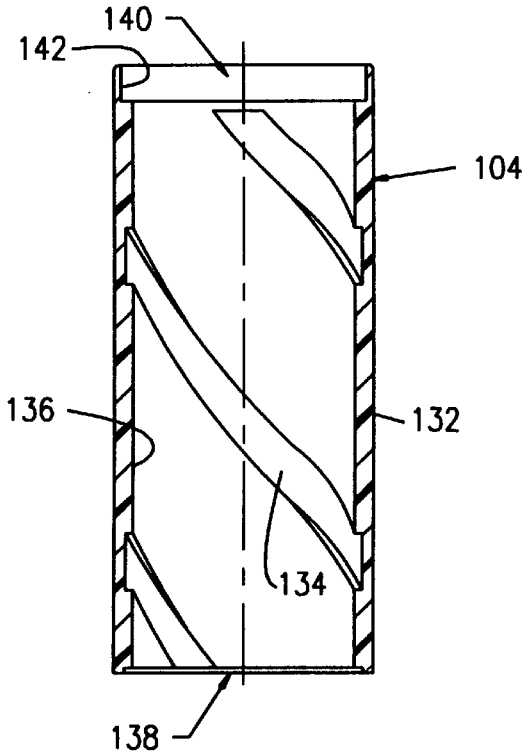
FIG. 3 is a cross-sectional view of the dispenser shell.

Referring now to FIG. 3, the outer shell 104 is constructed in the nature of a hollow tubular member 132 having an inside diameter slightly larger than the outside diameter of segment 116 of tubular member 110. The tubular member 132 is provided with a spiral shaped groove 134 formed in the interior surface 136. The spiral groove 134 communicates between the open ends 138, 140 of the tubular member 132. The interior surface 136 of the tubular member 132 adjacent open end 140 is provided with a circumscribing recess 142.

Shell 104 is positioned over segment 116 of the base 102 as best shown in FIG. 1. Due to the slight dimensional differences between the inside diameter of shell 104 and outside diameter of segment 116, the shell is rotatable about its longitudinal axis. In the arrangement thus far described, groove 134 is arranged overlying openings 124 and lateral openings 126 at various positions therealong as the shell is rotated. The shell 104 is retained in position by the lip 130 of rib 122 being received in generally interference or snapped fit within the recess 142 formed within the open end 140 of the shell. As thus far described, the base 102 and shell 104 are generally of conventional construction as heretofore known.

Turning now to FIGS. 4–7, a holder/carrier 106 constructed in accordance with one embodiment of the present invention will now be described The holder/carrier 106 is constructed from a hollow tubular member 144 generally defined by a cylindrical shaped wall 146 having an inner surface 148 and an outer surface 150. Other shapes such as oval, square and the like may be used in dispensers 100 having a generally similar shape. A pair of cam followers 152 are provided extending radially outward from the outer surface 150 of wall 136. The cam followers 152, generally cylindrical members, are spaced apart 180° so as to register with openings 124 within the base 102. In this regard, the cam followers 152 are sized so as to be slidingly received within opening 124 and lateral openings 126, while being received within the groove 134 within the shell 104. As such, the outside diameter of the holder/carrier 106 is slightly less than the inside diameter of segment 116 of the base 102 thereby enabling the holder/carrier to slide longitudinally therethrough during operation of the dispenser 100.

The holder/carrier 106 is further provided with a bottom wall 154 formed with a pair of spaced apart side openings 156. The bottom wall 154 is shown at a location spaced from the bottom open end 158 of the holder/carrier 106. It is to be understood that the bottom wall 154 may be positioned at other locations, for example, proximate to, adjacent or at the location of the bottom open end 158. In addition, the bottom wall 154 may be a continuous wall completely closing off the bottom open end 158 of the holder/carrier 106, as opposed to having the side openings 156.

A plurality of longitudinally extending ribs 160 may be formed along the inner surface 148 of the holder/carrier 106. The ribs 106 may have any cross-sectional shape, for example, triangular, rectangular, oval and the like, terminating at a point 162 or other shape as may be desired. Although four ribs 160 arranged spaced 90° apart are shown, it is to be understood that any greater or lesser number of ribs, as well as other shapes of such ribs may be provided on the inner surface 148. The ribs extend generally from the bottom wall 154 to a location proximate the upper open end 164 of the holder/carrier 106.

Figure 5:
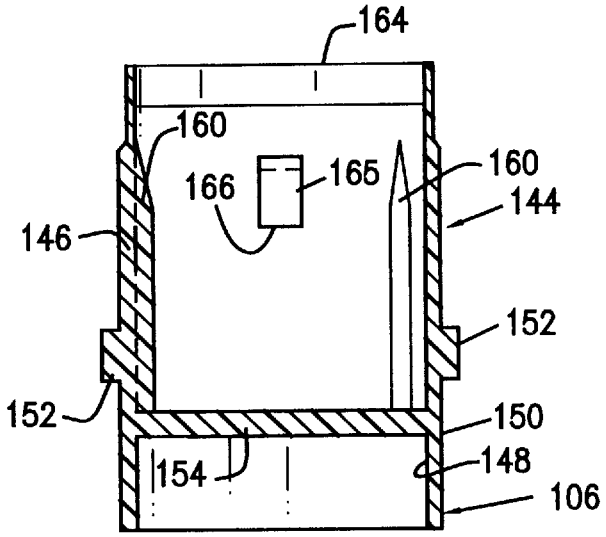
FIG. 5 is a cross-sectional view taken along line 5—5 in FIG. 4.
Figure 4:
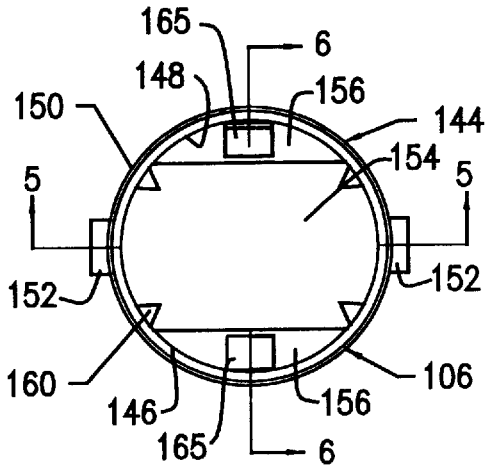
FIG. 4 is a top plan view of a holder or carrier in accordance with one embodiment of the present invention for securing a product in stick-like form therein.

In accordance with the present invention, at least one, and preferably a plurality of barbs 165 are provided extending inwardly from the inner surface 148 of wall 146 forming the holder/carrier 106. The overall shape of the barbs 165 in plan view, such as shown in FIG. 5, may take a variety of forms. For example, the barbs 165 may be rectangular, square, triangular, U-shaped, etc. The cross-sectional shape of the barbs 165 may be tapered, rectangular and the like. In addition, the free end 166 of the barbs 165 may also have a variety of shapes. In this regard, although the free end 166 is shown as being straight, as well as tapered, the free end could be curved, provided with undulations, saw teeth, rounded, pointed and the like.

Figure 7:
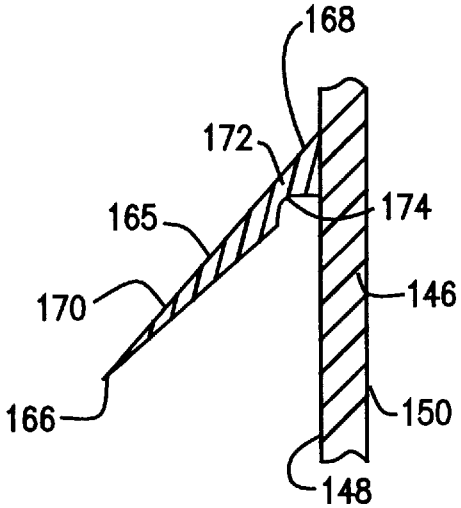
FIG. 7 is an enlarged cross-sectional view showing a barb constructed in accordance with one embodiment of the present invention.

As best shown in FIG. 7, the barbs 165 generally include an attachment portion 168, a distal portion 170 and a resilient/flexible portion 172. The attachment portion 168 is formed on the inner surface 148 extending outwardly therefrom. The resilient/flexible portion 172 connects the attachment portion 168 to the distal portion 170 by having an area of generally reduced cross-section compared to the attachment portion or the distal portion. In particular, the resilient/flexible portion 172 is formed with an inside radius 174 or curved portion which provides a smooth transition between the distal portion 170 and attachment portion 168 to avoid a stress point, as well as providing an area of reduced thickness, i.e., at the resilient/flexible portion 172. The radius 174 or curved portion may also be formed on the outside of the resilient/flexible portion 172. This construction of the barbs 165 facilitates the distal portion 170 bending or flexing about the resilient/flexible portion 172. However, it is contemplated that the distal portion 170 may be attached directly to the attachment portion 168 or to the inner surface 148.

Although the barbs 165 have been described as comprising an attachment portion 168, distal portion 170 and resilient/flexible portion 172, it is to be understood that the barbs are generally integrally formed as one solid continuous member from polymer material generally contemporaneously with the formation of the holder/carrier 106. By way of example, the barbs 165 as thus far described can be formed using injection molding in the direction of draw to form the barbs from the same material as the holder/carrier 106. As will be understood, the barbs 165 are intended to be resilient and flexible, as well as having spring-like properties. To this end, the barbs 165, as well as the remaining portions of the holder/carrier 106 can be formed from a variety of polymer materials which exhibit these properties, for example, nylon, polycarbonate, polypropylene and preferably Acetal polymer material. However, if desired, the barbs 165 can be formed from a polymer material different from that of the holder/carrier 106.

At least one barb 165, and preferably a plurality of such barbs, are provided extending inwardly within the interior of holder/carrier 106. The larger the size of the product to be dispensed, generally the greater the number of barbs 165 will be employed, as well as barbs potentially of greater size. The barbs 165 are generally uniformly spaced apart around the interior surface 148 of wall 146. However, a symmetrical arrangement of the barbs 165 is not required. As shown in accordance with one embodiment, the barbs 165 are positioned proximate the upper opened end 164 of the holder/carrier 106 so as to be spaced from the bottom wall 154. The barbs 165 are initially formed so as to create an angle with respect to the inner surface 148 of wall 146 on the order of about 30° by way of example only. However, the angle may be greater or smaller as desired, for example, generally in the range of about 15° to about 60°.

Figure 6:
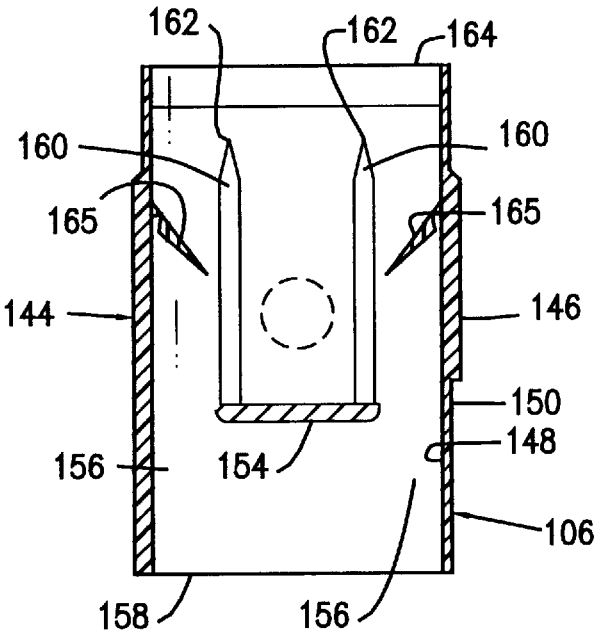
FIG. 6 is a cross-sectional view taken along line 6—6 in FIG. 4.
Figure 8A:
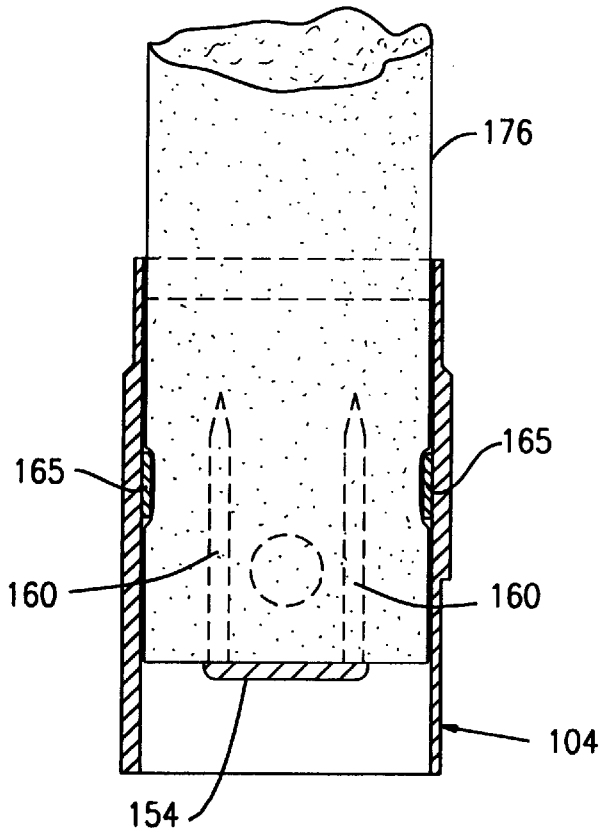
FIGS. 8A and 8B are cross-sectional views of the holder or carrier in operative relationship with a product of stick-like form during and after insertion within the holder or carrier.
Figure 8B:
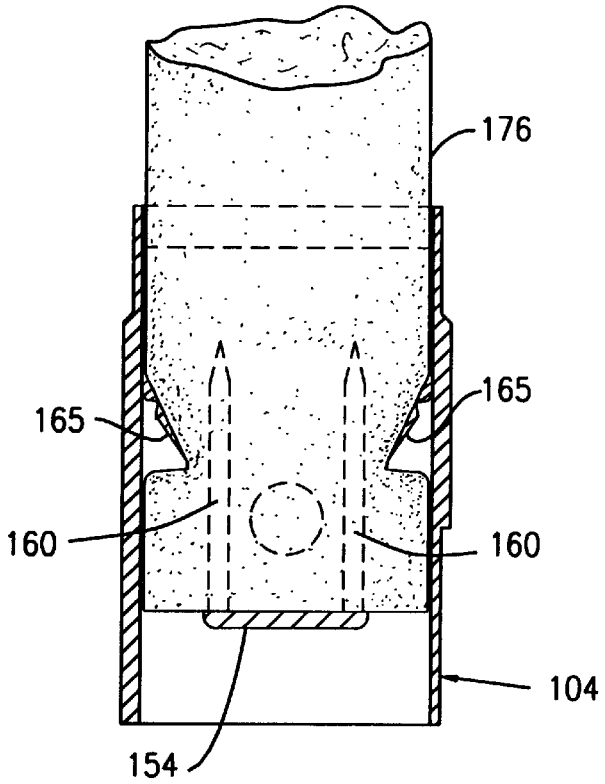

Referring now to FIGS. 8A and 8B, the operation of the dispenser 100 including the holder/carrier 106 will now be described. The holder/carrier 106 is initially arranged as shown in FIG. 6 with the barbs 165 extending outwardly into the interior of the holder/carrier. As previously noted, the barbs 165 are constructed from plastic polymer material which possesses spring-like properties. A billet 176 of the product in stick-like form to be dispensed is blown into the holder/carrier 106 through the upper opened end 164. Initially, the billet is cooled to provide the billet in a more rigid form, especially when the billet is in the nature of a semi-solid or one of high viscosity. As the billet 176 is blown into the holder/carrier 106, the barbs 165 are bent or pressed downwardly about the resilient/flexible portion 172 towards opposing inner surface 148 of wall 146. As shown in FIG. 8A, the barbs 165 are bent downwardly adjacent or into surface contact with the inner surface 148 thereby minimizing the obstruction for the insertion of the billet 176 into the holder/carrier 106.

As the billet 176 begins to soften by returning to room temperature, the barbs 165 due to their spring-like nature spring back towards their original position when formed as shown in FIG. 8B. As a result, the barbs 165 embed themselves into the surrounding portions of the billet 176. In this relationship, the free ends 166 of the barbs 165 point downwardly at an angle digging into the billet 176. In the event the billet 176, due to vibration, dropping or otherwise, was to move longitudinally within the holder/carrier 106, the barbs 166 would dig further into the billet precluding its longitudinal movement. In addition, the ribs 160 assist in precluding the billet 176 from twisting or rotating within the holder/carrier 106. It is also contemplated that the material forming the stick-like product can be molded directly into the holder/carrier 106 as opposed to being blown in in the form of a billet 176. For example, this technique can be used in forming stick-type deodorants, adhesive sticks, sunscreen sticks and the like.

The holder/carrier 106 is inserted into the base 102 by spreading the opened end 120 as facilitated by slot 128 so as to accommodate the cam followers 152. The cam followers 152 are received within the openings 124 and extend outwardly therefrom into the groove 134. In this manner, upon rotation of the shell 104 relative to base 102, the cam followers 152 will track within the groove 134 to cause the holder/carrier 106 to move longitudinally through the dispenser 100 thereby exposing various portions of the billet 176. Although the billet 176 has been described as being blown into the holder/carrier 106 prior to insertion into the base 102, it is to be understood that the billet may be blown into the holder/carrier after assembly with the base.

Figure 9:
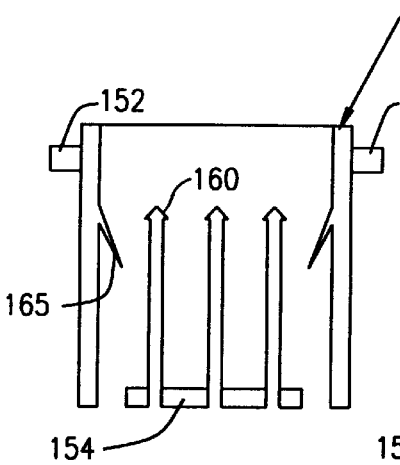
FIG. 9 is a cross-sectional view of a holder or carrier constructed in accordance with another embodiment of the present invention.
Figure 10:
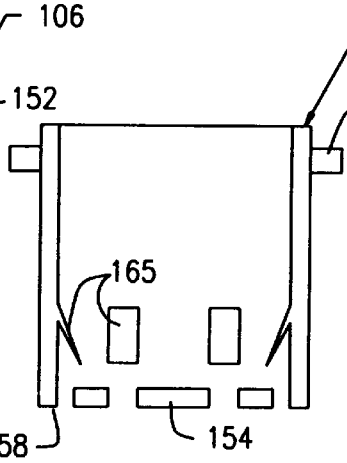
FIG. 10 is a cross-sectional view of a holder or carrier constructed in accordance with another embodiment of the present invention.
Figure 11:
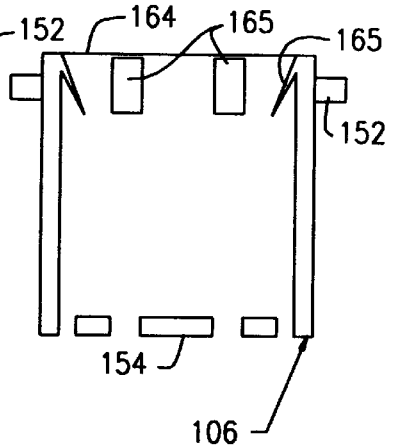
FIG. 11 is a cross-sectional view of a holder or carrier constructed in accordance with another embodiment of the present invention.

Referring now to FIGS. 9–11, there are shown various modifications of the holder/carrier 104 in accordance with the present invention. In the various embodiments disclosed, the bottom wall 154 is positioned adjacent the bottom open end 158 of the holder/carrier 106. As further shown in FIG. 9, the barbs 165 are arranged approximately midway along the length of the holder/carrier 106. In FIG. 10, the barbs 165 are located adjacent the bottom open end 158. As shown in FIG. 11, the barbs 165 are located adjacent the upper open end 164. It is further noted that ribs 160 have been eliminated from the holder/carriers 106 shown in FIGS. 10 and 11. Thus, it is to be understood that the location of the bottom wall 158 may vary between the bottom and upper open ends 158, 164. In addition, the location of the barbs 165 between the bottom and open ends 158, 164 can also be varied. In this regard, the barbs 165 are not required to be located all at the same vertical height, but may be staggered at various locations. In addition, it is not a requirement of the present invention to include ribs 160.

Figure 13:
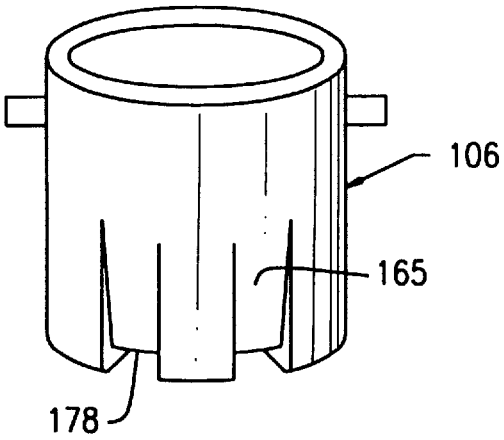
FIG. 13 is a perspective view of a holder or carrier constructed in accordance with another embodiment of the present invention.
Figure 12:
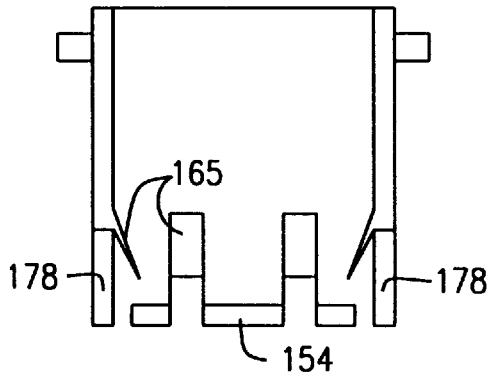
FIG. 12 is a cross-sectional view of a holder or carrier constructed in accordance with another embodiment of the present invention.
Figure 14:
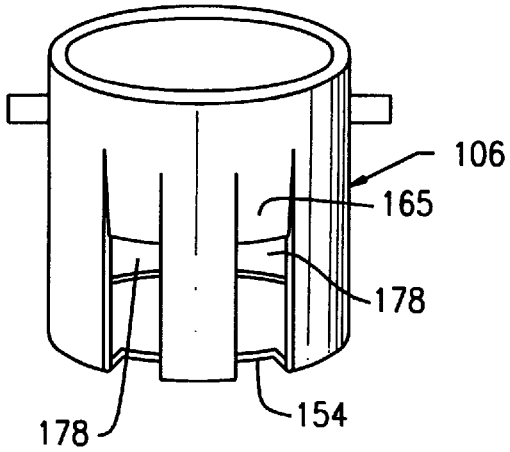
FIG. 14 is a perspective view of a holder or carrier constructed in accordance with another embodiment of the present invention.

Referring now to FIGS. 12–14, still further embodiments of the holder/carrier 106 in accordance with other embodiments will now be described. As thus far described, the wall 146 forming the holder/carrier 106 has been described as generally solid in form. Specifically, the barbs 165 have been described as being formed extending overlying a portion of the inner surface 148 of wall 146 as clearly shown in FIG. 6. However, it is to be understood that wall 146 may be provided with a cutout opposing barbs 165. For example, as shown in FIG. 12, barbs 165 are formed adjacent the bottom open end 158 opposing a cutout 178. The cutout 178 is more clearly shown in FIG. 13. The cutouts 178 are formed during the injection molding process used to form the holder/carrier 106. The barbs 165 formed in this manner opposing cutouts 178 may be produced by injection molding using cam action or slide action. The cutouts 178 provide a space into which the barbs 165 may be depressed during insertion of the billet 176. In the embodiment disclosed in FIG. 14, the barbs 165 are positioned midway along the length of the holder/carrier 106. The cutouts 178 are shown extending from the attachment portion 168 of the barbs 165 to the bottom wall 154. However, it is to be understood that the cutouts 178 may occupy a lesser degree of the sidewall 146.

Figure 15:
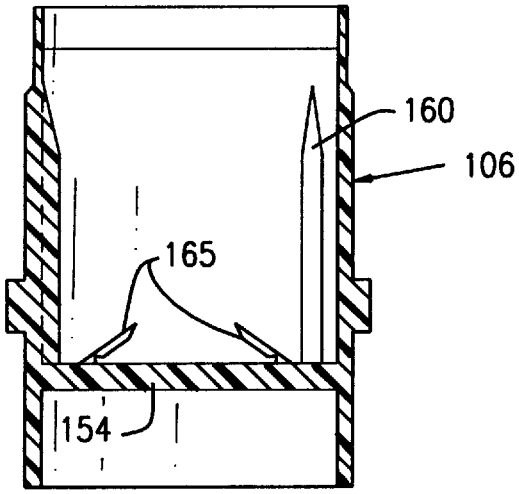
FIG. 15 is a cross-sectional view of a holder or carrier constructed in accordance with another embodiment of the present invention.

Turning now to FIG. 15, another embodiment of a holder/carrier 106 will be described. As thus far described, the barbs 165 have been positioned around the inner surface 148 of wall 146. It is also contemplated that barbs 165 may also be positioned on the surface of bottom wall 154 extending upwardly into the interior of the holder/carrier 106. This arrangement of the barbs 165 is particularly suited to use with stick forming material which are molded into the holder/carrier 106, as opposed to being blown in in the form of a billet 176.

Although the invention herein has been described with reference to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. A holder for a product having a stick-like form, said holder comprising a body including a solid sidewall portion having an interior surface defining an interior opening adapted for receiving a portion of said product, at least one barb of polymer material extending away from said interior surface of said solid sidewall portion into said interior opening, said barb including an attachment portion attached to said interior surface of said solid sidewall portion and a distal portion, said distal portion connected to said attachment portion by a resilient portion having a radius of curvature, said resilient portion enabling the displacement of said distal portion from a first position extending into said interior opening away from said interior surface of said solid sidewall portion to a second position extending within said interior opening overlying and proximate said interior surface of said solid sidewall portion upon said holder initially receiving said product therein, and thereafter, being extendible away from the underlying interior surface of said solid sidewall portion into a portion of said product received within said interior opening for preventing said product from being dislodged from said holder.

2. The holder of claim 1, wherein said body comprises a cylindrical hollow member.

3. The holder of claim 1, further including a plurality of said barbs arranged at spaced radial locations about said interior surface.

4. The holder of claim 1, wherein said resilient portion enables said distal portion to return to its extended position to embed into said product.

5. The holder of claim 1, wherein said barb has a generally rectangular shape.

6. The holder of claim 1, further including a product having a stick-like form received within said holder.

7. The holder of claim 1, further including a cosmetic product having a stick-like form received within said holder.

8. The holder of claim 1, wherein said polymer material has spring-like properties.

9. The holder of claim 1, wherein said at least one barb is an appendage independent from said body and attached thereto by said attachment portion.

10. A holder for a product having a stick-like form, said holder comprising a body including a solid sidewall portion having an interior surface defining an interior opening adapted for receiving a portion of said product, at least one barb of polymer material overlying said interior surface of said solid sidewall portion and extending away therefrom into said interior opening, said barb including a resilient portion having a cross-sectional thickness less than an adjacent portion of said barb, said resilient portion enabling the displacement of said barb to a position overlying and proximate said interior surface of said solid sidewall portion upon said holder initially receiving said product therein, and thereafter, being extendible away from the underlying interior surface of said solid sidewall portion into a portion of said product received within said interior opening for preventing said product from being dislodged from said holder.

11. The holder of claim 10, further including a product having a stick-like form received within said holder.

12. The holder of claim 11, wherein said product comprises a cosmetic product.

13. The holder of claim 10, wherein said polymer material has spring-like properties.

14. The holder of claim 10 wherein said resilient portion is defined by a curved portion.

15. The holder of claim 10, wherein said at least one barb comprises an appendage independent from said body, said barb having an attachment portion for attaching said barb to said body.

16. A dispenser for a product having a stick-like form, said dispenser comprising a housing, a product within said housing moveable between a storage position and a user position, a holder for receiving said product moveable within said housing between said storage position wherein said product is inaccessible for use and said user position wherein said product is accessible for use, said holder including a tubular body including a solid sidewall portion having an interior surface defining an interior opening receiving a portion of said product therein, and at least one barb of polymer material overlying and extending away from said interior surface of said solid sidewall portion into said interior opening, said barb including an attachment portion attached to said interior surface of said solid sidewall portion and a distal portion, said distal portion connected to said attachment portion by a resilient portion having a radius of curvature, said resilient portion enabling the displacement of said distal portion from a first position extending into said interior opening away from said interior surface of said solid sidewall portion to a second position within said interior opening overlying and proximate said interior surface of said solid sidewall portion upon said holder initially receiving said product therein, and thereafter, being extendible away from the underlying interior surface of said solid sidewall portion into a portion of said product within said interior opening for preventing said product from being dislodged from said holder when said holder is in said storage position and said user position.

17. The dispenser of claim 16, further including a cap enclosing one end of said housing when said product is in said storage position.

18. The dispenser of claim 16, wherein said body comprises a cylindrical hollow member.

19. The dispenser of claim 16, further including a plurality of said barbs arranged at spaced radial locations about said interior surface.

20. The dispenser of claim 16, wherein said resilient portion enables said distal portion to extend to its extended position to embed into said product.

21. The dispenser of claim 16, wherein said barb has a generally rectangular shape.

22. The dispenser of claim 16, wherein said product has a stick-like form.

23. The dispenser of claim 16, wherein said product comprises a cosmetic product.

24. The dispenser of claim 16, wherein said polymer material has spring-like properties.

25. The dispenser of claim 16, wherein said at least one barb is an appendage independent from said body and attached thereto by said attachment portion.

26. A dispenser for a product having a stick-like form, said dispenser comprising a housing, a product within said housing moveable between a storage position and a user position, a holder for receiving said product moveable within said housing between said storage position wherein said product is inaccessible for use and said user position wherein said product is accessible for use, said holder including a tubular body including a solid sidewall having an interior surface defining an interior opening receiving a portion of said product therein, and at least one barb of polymer material overlying and extending away from said interior surface of said solid sidewall into said interior opening, said barb including a resilient portion having a cross-sectional thickness less than an adjacent portion of said barb, said barb being displaceable within said interior opening overlying and proximate said interior surface of said solid sidewall upon initial engagement with said product, and thereafter, being extendable away from the underlying interior surface of said solid sidewall and into said product, said barb preventing said product from being dislodged from said holder when said holder is in said storage position and said user position.

27. The dispenser of claim 26, further including a cap enclosing one end of said housing when said product is in said storage position.

28. The dispenser of claim 26, wherein said product has a stick-like form.

29. The dispenser of claim 26, wherein said product comprises a cosmetic product.

30. The dispenser of claim 26, wherein said polymer material has spring-like properties.

31. The dispenser of claim 26, wherein said resilient portion is defined by a curved portion.

32. The dispenser of claim 31, wherein said curved portion connects a distal portion of said barb to an attachment portion attached to said interior surface.

33. The dispenser of claim 26, wherein said holder and said barb are integrally formed.

34. The dispenser of claim 26, wherein said product comprises lipstick.

35. The dispenser of claim 26, wherein said at least one barb is an appendage independent from said body, said barb having an attachment portion for attaching said barb to said body.

36. A holder for a product having a stick-like form, said holder comprising a hollow body having a solid sidewall having an interior surface defining an interior opening adapted for receiving a portion of said product, at least one barb of polymer material attached to and extending from said solid sidewall of said body into said interior opening overlying said interior surface of said solid sidewall, said barb being displaceable within said interior opening proximate an underlying portion of said solid sidewall of said body when said holder initially receives said product therein, and thereafter, being extendible away from the underlying portion of said solid sidewall into a portion of said product for preventing said product from being dislodged from said holder.

37. The holder of claim 36, wherein said body comprises a cylindrical hollow member.

38. The holder of claim 36, further including a plurality of said barbs arranged at spaced radial locations about said interior surface.

39. The holder of claim 36, wherein said barb includes an attachment portion connected to said inner surface and a distal portion, said distal portion connected to said attachment portion by a resilient portion enabling the displacement of said distal portion proximate the underlying interior surface.

40. The holder of claim 39, wherein said resilient portion enables said distal portion to return to its extended portion to embed into said product.

41. The holder of claim 39, wherein said resilient portion includes a radius of curvature.

42. The holder of claim 36, wherein said barb has a generally rectangular shape.

43. The holder of claim 36, further including a product having a stick-like form received within said holder.

44. The holder of claim 36, wherein said barb includes a resilient portion which maintains said barb normally extending outwardly into said opening away from the underlying interior surface and enabling said barb to be displaceable proximate the underlying interior surface.

45. The holder of claim 36, further including a cosmetic product having a stick-like form received within said holder.

46. The holder of claim 36, wherein said polymer material has spring-like properties.

47. The holder of claim 36, wherein said at least one barb is an appendage independent from said body, said barb having an attachment portion for attaching said barb to said body.

48. A dispenser for a product having a stick-like form, said dispenser comprising a housing, a product within said housing moveable between a storage position and a user position, a holder for receiving said product moveable within said housing between said storage position wherein said product is inaccessible for use and said user position wherein said product is accessible for use, said holder including a tubular body having a solid interior surface defining an interior opening receiving a portion of said product therein, and at least one barb of polymer material attached to and extending from said solid interior surface of said body into said opening overlying a portion of said solid interior surface, said barb being displaceable from within said interior opening overlying and proximate an underlying solid interior surface of said body when said holder initially receives said product therein, and thereafter, being extendible away from the underlying solid interior surface into a portion of said product for preventing said product from being dislodged from said holder when said holder is in said storage position and said user position.

49. The dispenser of claim 48, further including a cap enclosing one end of said housing when said product is in said storage position.

50. The dispenser of claim 48, wherein said body comprises a cylindrical hollow member.

51. The dispenser of claim 48, wherein said barb including an attachment portion connected to said inner surface and a distal portion, said distal portion connected to said attachment portion by a resilient portion enabling the displacement of said distal portion proximate the underlying interior surface.

52. The dispenser of claim 51, wherein said resilient portion enables said distal portion to extend to its extended position to embed into said product.

53. The dispenser of claim 51, wherein said resilient portion includes a radius of curvature.

54. The dispenser of claim 48, wherein said barb has a generally rectangular shape.

55. The dispenser of claim 48, wherein said product has a stick-like form.

56. The dispenser of claim 48, wherein said product comprises a cosmetic product.

57. The dispenser of claim 48, wherein said barb includes a resilient portion which maintains said barb normally extending outwardly into said opening away from the underlying interior surface and enabling said barb to be displaceable proximate the underlying interior surface.

58. The dispenser of claim 48, wherein said polymer material has spring-like properties.

59. The dispenser of claim 48, wherein said at least one barb is an appendage independent from said body, said barb having an attachment portion for attaching said barb to said body.

* * * * *